US011771148B2

(12) United States Patent
Karp

(10) Patent No.: US 11,771,148 B2
(45) Date of Patent: Oct. 3, 2023

(54) COMBINATION NURSING ARTICLE

(71) Applicant: HB Innovations, Inc., Los Angeles, CA (US)

(72) Inventor: Nina Montee Karp, Los Angeles, CA (US)

(73) Assignee: HB Innovations, Inc., Los Angeles, CA (US)

( * ) Notice: Subject to any disclaimer, the term of this patent is extended or adjusted under 35 U.S.C. 154(b) by 9 days.

(21) Appl. No.: 16/913,313

(22) Filed: Jun. 26, 2020

(65) Prior Publication Data

US 2021/0401073 A1 Dec. 30, 2021

(51) Int. Cl.
*A41D 1/215* (2018.01)
*A41D 31/18* (2019.01)

(52) U.S. Cl.
CPC ..... *A41D 1/215* (2018.01); *A41D 31/185* (2019.02)

(58) Field of Classification Search
CPC ..... A41D 1/215; A41D 31/185; A41D 1/22; A41D 1/21
See application file for complete search history.

(56) References Cited

U.S. PATENT DOCUMENTS 1,977,465 A * 10/1934 Aronson ..... A41B 9/06 2/73
2,213,900 A * 9/1940 Buchanan ..... A41D 15/02 2/72
2,310,855 A * 2/1943 Manson ..... A41C 3/08 450/34
4,104,742 A * 8/1978 Rahaim ..... A41D 15/02 2/213
4,144,593 A * 3/1979 Timmons ..... A41D 1/215 2/104
4,208,743 A * 6/1980 Whitcraft ..... A41D 1/215 2/104
4,446,572 A * 5/1984 Lindquist ..... A41D 1/215 2/104

(Continued)

FOREIGN PATENT DOCUMENTS

KR 10-2009-0109434 10/2009
WO WO-2005044028 A1 * 5/2005 ..... A41D 1/215

(Continued)

OTHER PUBLICATIONS

International Search Report and Written Opinion, PCT/US2021/037737, dated Oct. 6, 2021.

*Primary Examiner* — Alissa L Hoey
(74) *Attorney, Agent, or Firm* — Akerman LLP

(57) ABSTRACT

A combination nursing article includes a first piece and a second piece. The first piece may include an upper portion, a lower portion, and an empire waist between the upper and lower portions. The upper portion may include an upper inner layer configured to extend around a bust of a wearer. The second piece may include an upper outer layer configured to be worn as a camisole bra over the upper inner layer. The second piece may also include an elastomeric band configured to extend over the first piece, below breasts and around a torso of the wearer. When worn, a lower edge of the second piece is configured to be lifted and pulled upwardly to expose an upper edge of the upper inner portion and the upper edge of the upper inner portion is configured to be pulled downwardly to expose a nipple for nursing.

10 Claims, 6 Drawing Sheets

(56) References Cited

U.S. PATENT DOCUMENTS 4,528,699 A * 7/1985 Hughes ..... A41D 1/215 2/104
4,601,068 A * 7/1986 Frechette ..... A41D 1/215 2/104
4,911,677 A * 3/1990 White ..... A41C 3/04 2/104
4,957,466 A * 9/1990 Hopps ..... A41C 3/0057 450/23
5,119,511 A * 6/1992 Packer ..... A41D 7/00 450/67
5,461,725 A * 10/1995 Witczak ..... A41D 1/215 450/32
7,448,090 B2 * 11/2008 Lucock ..... A41D 1/205 2/104
8,235,766 B2 8/2012 Melarti et al.
8,585,458 B2 * 11/2013 Armanino ..... A41D 1/22 450/33
8,769,718 B2 * 7/2014 Riehl ..... A41D 1/22 2/67
11,096,427 B2 * 8/2021 Myers Phipps ..... A61M 1/062
2004/0166766 A1 * 8/2004 Schneider ..... A41C 3/04 450/36
2005/0028243 A1 * 2/2005 Polzin ..... A41D 1/215 2/104
2007/0074330 A1 * 4/2007 Azaronak ..... A41D 1/215 2/104
2007/0105481 A1 * 5/2007 Scholz ..... A41D 1/215 450/3
2007/0174945 A1 * 8/2007 Lehane ..... A41D 1/215 2/104
2007/0271675 A1 * 11/2007 Eraca ..... A41D 13/1236 2/104
2009/0265831 A1 * 10/2009 Hendrickson ..... A41D 1/215 2/104
2010/0031418 A1 * 2/2010 Op't Hof ..... A41D 1/215 2/113
2014/0220860 A1 * 8/2014 Alva ..... A41C 3/04 450/36
2014/0273737 A1 * 9/2014 Cortese ..... A41C 3/04 450/31
2014/0352026 A1 * 12/2014 Ruth Ann ..... A41D 27/02 2/69
2015/0196064 A1 * 7/2015 Melarti ..... A41B 9/04 450/95
2016/0206007 A1 * 7/2016 Op't Hof ..... A41D 1/215
2017/0303606 A1 * 10/2017 Curry ..... A41F 15/002
2018/0049483 A1 * 2/2018 Shore ..... A41D 27/24
2018/0092408 A1 * 4/2018 Hensel ..... A41C 3/04
2019/0116893 A1 * 4/2019 Blacker ..... A41D 1/215
2019/0261703 A1 * 8/2019 Zodel ..... A41D 1/21
2019/0320738 A1 * 10/2019 Kiuchi ..... A41B 9/06
2020/0297042 A1 * 9/2020 Carlino ..... A41C 5/00
2020/0305518 A1 * 10/2020 Cardenas ..... A41D 1/215
2021/0274858 A1 * 9/2021 Garramone ..... A41D 1/215

FOREIGN PATENT DOCUMENTS

WO 2011119070 9/2011
WO 2018117960 10/2018
WO WO-2018177960 A2 * 10/2018 ..... A41D 1/215

* cited by examiner

COMBINATION NURSING ARTICLE

TECHNOLOGY

The present disclosure is directed to clothing articles for nursing mothers, more specifically, the present disclosure is directed to clothing articles that provide easy access to nipples for nursing while being worn.

BACKGROUND

Nursing mothers may nurse children multiple times per day for various durations. Typical clothing may be awkward, inconvenient, and uncomfortable with respect to accessing nipples for nursing. Manipulating typical clothing tops to expose nipples for nursing may also stretch-out such tops. Various combination nursing articles are currently available to nursing mothers to ease nursing. One example combination nursing article is a nursing bras. Nursing bras may include material that may be folded down or laterally to expose a breast or nipple. Some maternity clothing include easily detachable straps that allow breasts to be easily exposed. Other examples include tops having nipple flaps, zipper access to nipples, or loose breast coverings that may be lifted, pulled down, or pushed to a side to expose nipples. However, new and improved combination nursing articles are needed to provide additional choices to better meet preferences of nursing mothers and that may better suit one or more of the many body types of nursing mothers.

SUMMARY

In one aspect, a combination nursing article includes a first piece and a second piece. The first piece may include an upper portion, a lower portion, and an empire waist between the upper and lower portions. The upper portion may include an upper inner layer configured to extend around a bust of a wearer. The second piece may include an upper outer layer configured to be worn as a camisole bra over the upper inner layer. The second piece may also include an elastomeric band configured to extend over the first piece, below breasts and around a torso of the wearer. When worn, a lower edge of the second piece is configured to be lifted and pulled upwardly to expose an upper edge of the upper inner portion and the upper edge of the upper inner portion is configured to be pulled downwardly to expose a nipple for nursing.

In one embodiment, the lower edge of the second piece comprises the elastomeric band.

In one embodiment, the band of the first piece is configured to overlap with the band of the second piece when worn.

In one embodiment, the second piece includes one or more shoulder straps.

In one embodiment, the lower portion comprises a skirt.

In one embodiment, the lower portion comprises shorts or pants.

BRIEF DESCRIPTION OF THE DRAWINGS

The novel features of the described embodiments are set forth with particularity in the appended claims. The described embodiments, however, both as to organization and manner of operation, may be best understood by reference to the following description, taken in conjunction with the accompanying drawings in which:

DESCRIPTION

Figure 1A:
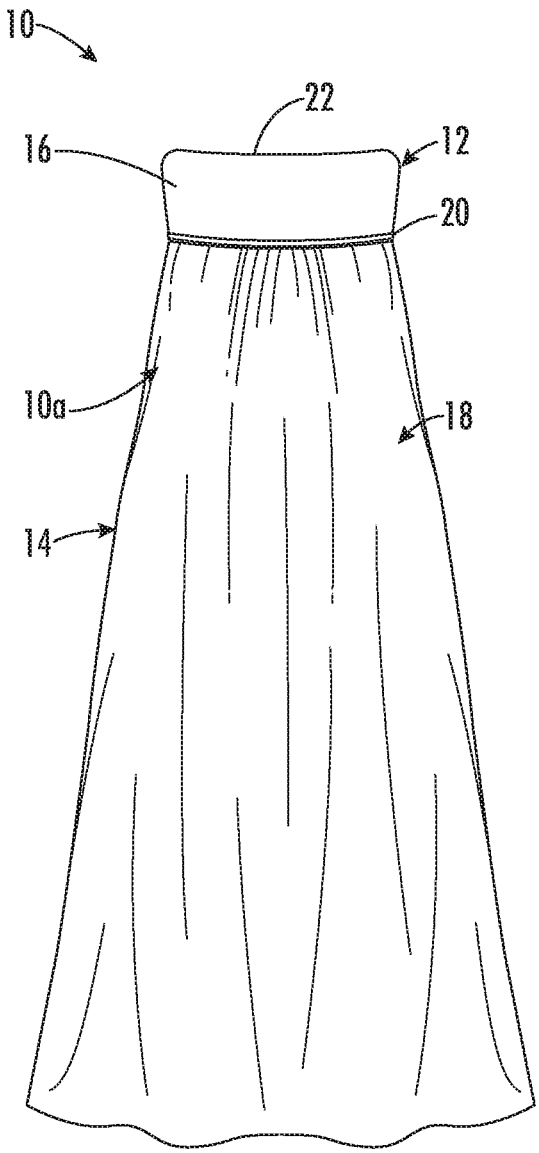
FIG. 1A illustrates a first piece of a combination nursing article according to various embodiments described herein.

The present disclosure describes a combination nursing article particularly useful for nursing mothers. The combination nursing article is configured to allow the wearer convenience to exposure of one or both nipples and/or breasts for nursing a child.

The combination nursing article may comprise a first piece and a second piece. The first piece may comprise an empire waisted garment having an upper portion and a lower portion, which may comprise pants, shorts, or skirt configurations. The upper portion is configured to extend around an upper torso of a wearer. An upper inner layer may situate along the upper portion of the first piece. The upper inner layer may be dimensioned to extend over breasts of the wearer.

The lower portion may be dimensioned to extend from below the breasts toward a waist of the wearer. The lower portion may preferably extend from the upper portion to around hips and thighs of the wearer in use. In some embodiments, the lower portion may be dimensioned to extend from below the breasts to lower legs of a wearer and comprise a dress. In another example, the lower portion may comprise pants or shorts. The first portion and second portion may comprise various materials such natural and/or synthetic materials such as cotton, cotton blends, jersey material, woven or knit fabric. In some embodiments, the first portion and second portion may comprise a same or different material. In one embodiment, the first portion and/or second portion comprise a material having elastomeric properties such as an elastomeric material and/or an elastomeric weave or knit.

A band may extend between the upper portion, such as the upper inner layer region thereof, and the lower portion. The band may be positioned to extend around the torso, just below the breasts of the wearer. The band may comprise a material having elastic properties and may be dimensioned and configured to apply sufficient pressure around the torso of a wearer to support maintaining positioning of the second piece around the torso of the wearer in use. In one example, elastomeric properties of the band are greater than that of the upper portion and/or the lower portion. The band may be configured to provide an empire waist configuration. In some embodiments, the second piece may not require shoulder support to maintain the second piece on the wearer. However, in one embodiment, the upper portion may include one or more shoulder straps, which in one example may be detachable.

The second piece may be dimensioned to extend around the upper torso of the wearer and therealong position around breasts of a wearer in use. The second piece includes an upper outer layer configured to position over the upper inner layer of the first piece when worn, thereby forming an outer layer. In some embodiments, the upper outer layer may be dimensioned to snuggly fit around the breasts of the wearer. The upper outer layer may comprise various materials such natural and/or synthetic materials such as cotton, cotton blends, jersey material, woven or knit fabric. In some embodiments, the upper outer layer comprises a same material as the first portion and/or second portion of the first piece. In other embodiments, the upper outer layer may comprise material different from that of the first portion and/or second portion. In one embodiment, the upper outer layer comprises a material having elastomeric properties such as an elastomeric material and/or an elastomeric weave or knit. The upper outer layer may be sized to the wearer's breast and/or corresponding torso circumferences. The fit may be sufficient to maintain the second piece around the breasts when worn. In a further or another embodiment, the second piece may include material that extends over one or both shoulders of the wearer, such as shoulder straps, for suspending the upper outer layer over the breast of the wearer. In one example, the second piece includes sleeves for receiving arms of the wearer. In an above or another embodiment, the second piece may include a band dimensioned to extend around the torso of the wearer, below the breasts. The band may comprise a material having elastomeric properties to assist in positioning of the upper outer layer around the upper torso and breasts of the wearer and/or provide breast support. In one example, elastomeric properties of the band are greater than that of the upper outer layer. In one example, the band extends along a lower edge of the upper outer layer. In one embodiment, the second piece may be configured as a camisole bra.

As introduced above, in use, the upper outer layer may be worn over the upper inner layer of the first piece. To access a breast or nipple for nursing, a lower edge of the upper outer layer may be lifted upward to access an upper edge of the upper inner layer. The upper inner layer may then be pulled downward to expose a nipple for nursing a child. After nursing, the upper edge of the upper inner layer may be lifted upward over the breast and the lower edge of the upper outer layer may be pulled downward over the upper inner layer.

In various embodiments, the combination nursing article comprises a first empire waisted garment having an upper portion and a lower portion. The upper portion is configured to extend around the bust of a wearer and the lower portion is configured to extend from the empire waist toward the hips and legs and may include pant, short, or skirt configurations. The combination nursing article also includes a camisole garment comprising a bra-like structure configured to be worn around the bust of the wearer, over the upper portion. A method of using the combination nursing article to expose a nipple for nursing may include lifting a lower edge of the camisole garment and pulling the lower edge upward to expose an upper edge of the upper portion of the empire waisted garment. The upper edge of the upper portion may then be pulled downward to expose the nipple. During nursing, the upper edge of the upper portion may comfortably position below the nipple or both the nipple and the corresponding breast and the lower edge of the camisole garment may comfortably position above the nipple or both the nipple and the corresponding breast. The empire waist may comprise a band having elastomeric properties as described herein and be dimensioned to provide a fitting that supports the empire waist about the upper torso, below the breasts. In one example, the lower edge of the camisole garment may similarly have elastomeric properties for conforming to contours of the wearer's upper torso, below the breasts, and allowing the lower edge or associated band to be expanded for lifting over breasts for nursing.

The upper inner layer and/or the upper outer layer may be configured with built-in lift support to support breasts. For example, the layer combination may together provide a soft nursing bra having built-in lift support with the look of a camisole dress. In various embodiments, the upper inner layer and the upper outer layer together comprise three or more layers of fabric, such as four layers of fabric. The fabric may be configured for optimal stretch, recover, durability, and stain resistance. In one example, the first piece (e.g., upper portion and/or lower portion) and/or second piece (e.g., the upper outer layer) may comprise a mélange type fabric such as tricot, cheviot, tricotine, canton, covert, or thin felt, for example. In one example, such fabric comprises between 35% and 60% recycled polyester, such as between about 45% and 50%. In one example, the first piece (e.g., upper portion and/or lower portion) and/or second piece (e.g., the upper outer layer) comprise a polyester tencel knit blend, such as a polyester/tencel jersey blend. In a further example, the blend comprises between 35% and 60% recycled polyester, such as between about 45% and 50%. In one embodiment, the nursing article comprises a combination camisole dress and soft-support nursing bra that includes multiple fabric layers and a soft nursing bra. For example, the nursing article may comprise a combination four layer camisole and soft nursing bra. Due to its utilization of upper inner and outer layers that may be easily manipulated for nursing in a combination camisole and soft-support bra configuration, the nursing article may be arranged to provide a flattering tailored design that slims and compliments all body types. The ability to easily expose a nipple as described herein provides no-fuss, discrete nursing. While the design of the nursing article is optimal for nursing, the empire waist design is also great for pregnancy and for years thereafter. The comfort provided by the nursing article makes it suitable for 24 hour, day and night wear.

FIGS. 1A-6B illustrate exemplary combination nursing article and pieces thereof according to various embodiments wherein like numbers reference like features.

Figure 1B:
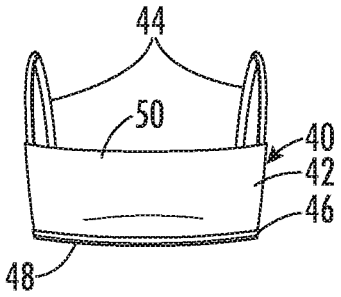
FIG. 1B illustrates a second piece of a combination nursing article according to various embodiments described herein.
Figure 2A:
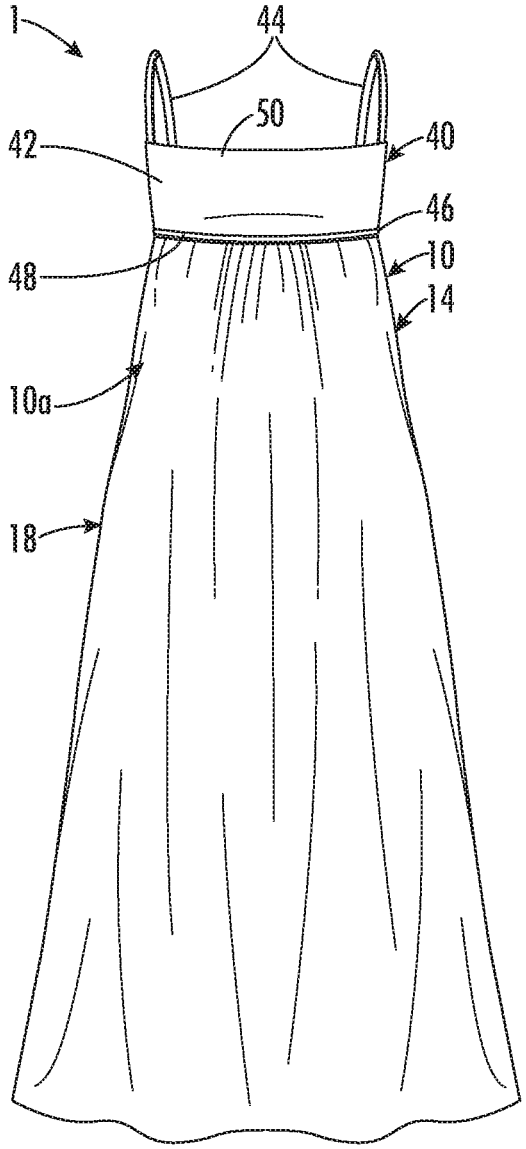
FIG. 2A illustrates a front view of a combination nursing article according to various embodiments described herein.

FIG. 1A illustrates an example of a first piece 10 of a combination nursing article 1 (see, e.g., FIG. 2A). The first piece 10 includes an upper portion 12 and a lower portion 14 and comprises an empire waisted garment 10*a*. The upper portion includes an upper layer configured to provide an inner layer when in use with a second piece 40 (see, e.g., FIG. 1B), and may be referred to herein as an upper inner layer 16. The upper portion 12 is dimensioned to extend around an upper torso of the wearer, including the breasts. In particular, the upper inner layer 16 may extend over the breasts when worn. The lower portion 14 is dimensioned to extend from below the breasts toward a waist of the wearer and may preferably extend around hips and thighs. In the illustrated embodiment, the lower portion 14 is dimensioned to extend from below the breasts of the wearer to lower legs of the wearer and comprises a dress or skirt 18. In another example, the lower portion 14 may include pant legs, e.g., pants or shorts.

The upper inner layer 16 may comprise one or more layers of fabric or other material. For example, the upper inner layer 16 may comprise two layers of fabric or four layers of fabric. As introduced above, the upper portion 12, upper inner layer 16 thereof, and lower portion 14 may comprise various materials such natural and/or synthetic materials such as blends, cotton, cotton blends, jersey material, woven or knit fabrics. For example, the upper portion 12 and/or lower portion 14 may comprise a mélange type fabric such as tricot, cheviot, tricotine, canton, covert, or thin felt, for example. In one example, such fabric comprises between 35% and 60% recycled polyester, such as between about 45% and 50%. In one example, the upper inner layer 16 comprises a material having elastomeric properties allowing the upper inner layer 16 to remain positioned around the breasts of the wearer unless manipulated to be stretched and pulled down by the user. In one example, the upper portion 12 (e.g., upper inner layer 16) and/or lower portion 14 comprise a polyester tencel knit blend, such as a polyester/tencel jersey blend. In a further example, the blend comprises between 35% and 60% recycled polyester, such as between about 45% and 50%. The fabric may be configured for optimal stretch, recover, durability, and stain resistance. The upper and lower portions 12, 14 may comprise a same or different material.

A band 20 is positioned between the upper portion 12 and the lower portion 14 of the first piece 10. When worn, the band 20 is configured to extend around the torso, just below the breasts of the wearer, to maintain the position of the band 20 therealong. For example, the band 20 may be configured to provide an empire waist. The band 20 may comprise a material having elastomeric properties and be dimensioned to apply sufficient pressure around the torso of the wearer to support maintaining the position of the band 20 just below the breasts of the wearer. For example, the band 20 may comprise an elastic material and/or weave or knit having elastomeric properties to maintain positioning of the band 20 when in use. The band 20 may have various vertical lengths, such as between about 0.1 inches and about 5 inches, between about 0.5 inches and about 3 inches, or about 1 inch, for example. An upper edge 22 of the upper inner layer 16 may comprise a straight-cut, princess cut, V-neck, scoop/crew neck, or other suitable neckline cut.

FIG. 1B illustrates a second piece 40 of a combination nursing article 1 (see, e.g., FIG. 2A) according to various embodiments described herein. The second piece 40 is dimensioned to extend around the upper torso of the wearer and therealong position around breasts in use. The second piece 40 comprises a camisole bra-like configuration including an upper outer layer 42 configured to be worn as a camisole bra over the upper inner layer 16 of the upper portion 12 of the first piece 10. For example, the upper outer layer 42 is dimensioned to position over the upper inner layer 16 of the first piece 10 when worn, thereby forming an outer layer. The second piece 40 further includes shoulder straps 44 for supporting the second piece 40 and the breasts. Additionally or alternatively, the upper outer layer 42 may be dimensioned to snuggly fit around the breasts of the wearer. The upper outer layer 42 may be sized to the wearer's breast and/or corresponding bust/torso circumferences. In one configuration, the fit of the upper outer layer 42 may be sufficient to maintain the upper outer layer 42 around the breasts when worn. The upper outer layer 42 may comprise one or more layers of fabric or other material. For example, the upper outer layer 42 may comprise two layers of fabric or four layers of fabric. Various materials may be used such natural and/or synthetic materials such as cotton, cotton blends, jersey material, woven or knit fabrics. For example, the upper outer layer 42 may comprise a mélange type fabric such as tricot, cheviot, tricotine, canton, covert, or thin felt, for example. In one example, such fabric comprises between 35% and 60% recycled polyester, such as between about 45% and 50%. In one example, the upper outer layer may comprises an elastomeric weave, knit, or other material providing elasticity. In another embodiment, the upper outer layer does not include elastomeric properties. In one example, the upper outer layer 42 comprises a polyester tencel knit blend, such as a polyester/tencel jersey blend. In a further example, the blend comprises between 35% and 60% recycled polyester, such as between about 45% and 50%. The fabric may be configured for optimal stretch, recover, durability, and stain resistance.

The second piece 40 may include a band 46 along a lower edge 48 of the upper outer layer 42 dimensioned to extend around the torso of the wearer, below the breasts. The band 46 may be configured to have elastomeric properties to provide additional breast support. For example, the band 46 may comprise an elastic material and/or weave or knit having elastomeric properties to assist in positioning of the upper outer layer 42 around the upper torso and breasts of the wearer and/or provide breast support. The band 46 may have a degree of elasticity that extends beyond that of the torso of the wearer to allow the wearer to easily expand the band 46 to lift it upward over a breast to reveal the upper inner layer 16 of the first piece 10 and retract to comfortably position above the breast for nursing as well as expanding and then retracting again to position the upper outer layer back over the upper inner layer 16 following nursing. The band 46 may have various vertical lengths, such as between about 0.1 inches and about 5 inches, between about 0.5 inches and about 3 inches, or about 1 inch, for example. The upper outer layer 42 may also include an upper edge 50. The upper edge 50 may be straight-cut, princess cut, V-neck, scoop/crew neck, or other suitable neckline cut. The configuration of the upper edge 50 may correspond with that of the upper edge 22 of upper inner layer 16 or may be different. In one example, the upper edge 50 of the upper outer layer 42 is configured to cover the upper edge 22 of the upper inner layer 16.

Figure 2B:
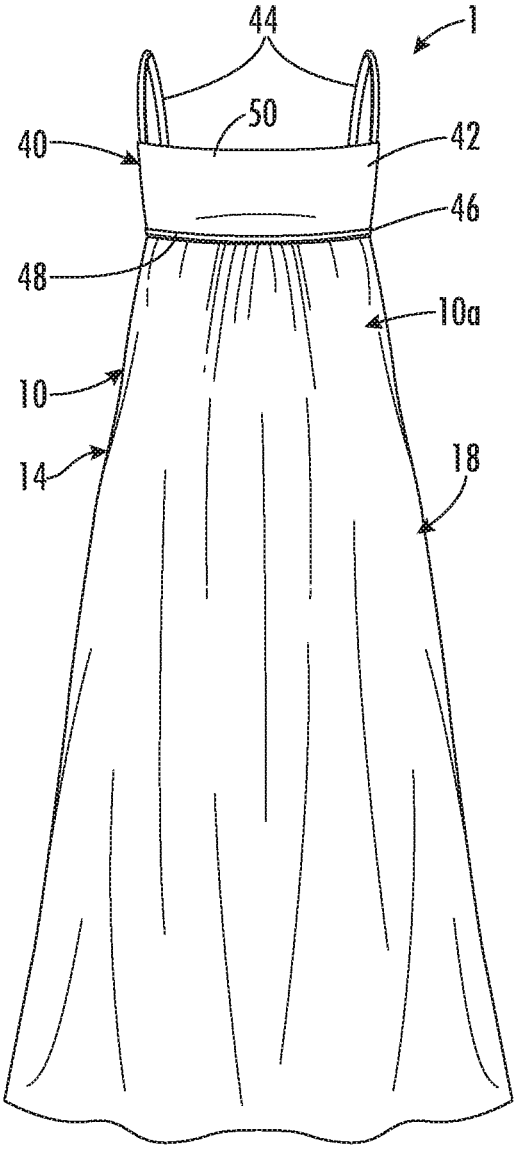
FIG. 2B illustrates a rear view of the combination nursing article of FIG. 2A according to various embodiments described herein.

As introduced above, in use, the upper outer layer 42 may be worn over the upper inner layer 16 of the first piece 10. FIGS. 2A & 2B illustrates respective front and rear views a combination nursing article 1 wherein the upper outer layer 42 of the second piece 40 is positioned over the upper inner layer 16 of the first piece 10. The first and second pieces 10, 40 may be configured as described above and elsewhere herein. In the illustrated embodiment, outer and upper inner layers 42, 16 substantially overlap along rear portions thereof. In another embodiment, the outer and upper inner layers 42, 16 may have different configurations such as racer, halter, or crisscross and may not substantially overlap. In an above or another embodiment, the second piece 40 may be strapless. When layered, the bands 20, 46 may substantially overlap as shown. In another example, the bands 20, 46 may be offset.

Figure 6A:
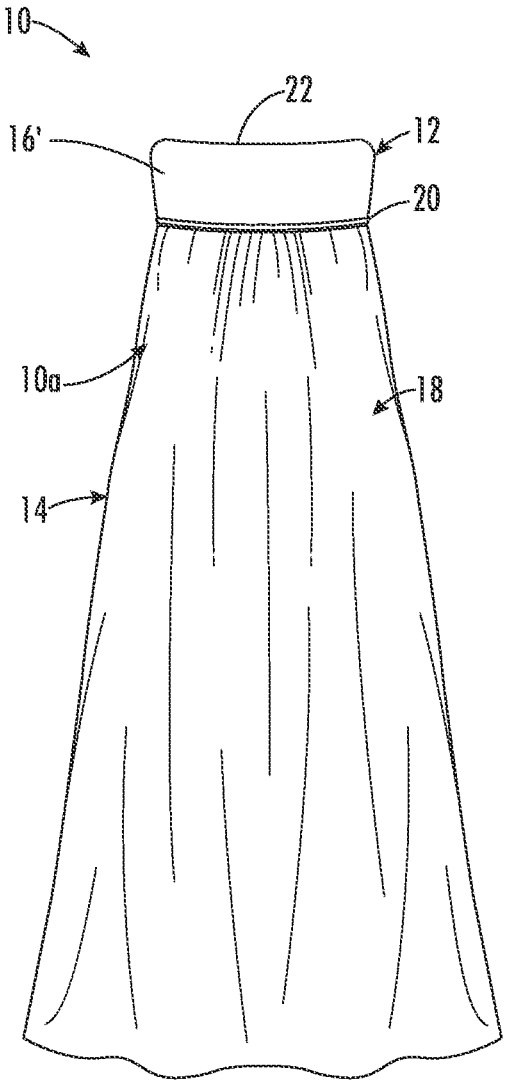
FIGS. 6A & 6B illustrate first and second pieces, respectively, of a combination nursing article configured to be worn with the second piece over the first piece in a manner shown in FIGS. 2A & 2B according to various embodiments described herein.
Figure 6B:
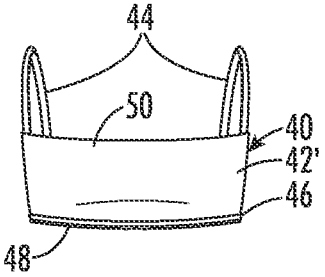

In one embodiment, the upper outer layer 42 and upper inner layer 16 together comprise four layers of fabric. For example, the upper outer layer 42 may comprise two layers of fabric and the upper inner layer 16 may comprise two layers of fabric, the upper outer layer 42 may comprise one layer of fabric and the upper inner layer 16 may comprise three layers of fabric, or the upper outer layer 42 may comprise three layers of fabric and the upper inner layer 16 may comprise one layer of fabric. FIGS. 6A & 6B illustrate upper outer layer 42' and upper inner layer 16' each comprising two layers of fabric. The lower portion 14 may similarly comprise one to four layers of fabric, which in some embodiments may be the same number of layers of fabric as the upper inner layer 16. As introduced above, the fabric may comprise a jersey material, for instance, including a mélange type fabric such as tricot, cheviot, tricotine, canton, covert, or thin felt. In one example, such fabric comprises between 35% and 60% recycled polyester, such as between about 45% and 50%. In one example, the upper outer layer 42 and the upper inner layer 16 comprises a polyester tencel knit blend, such as a polyester/tencel jersey blend. In a further example, the blend comprises between 35% and 60% recycled polyester, such as between about 45% and 50% or approximately 48.5% (+/−1%). In one such example, the upper outer layer 42 comprises two layers of fabric and the upper inner layer 16 comprises two layers of fabric. The fabric may be configured for optimal stretch, recover, durability, and stain resistance. For example, the upper inner layer 16 and/or the upper outer layer 42 may be configured with built-in lift support to support breasts. For example, the layer combination may together provide a soft nursing bra having built-in lift support with the look of a camisole dress. Due to its utilization of upper inner and outer layers that may be easily manipulated for nursing in a combination camisole and soft-support bra configuration, the nursing article 1 may be arranged to provide a flattering tailored design that slims and compliments all body types. The ability to easily expose a nipple as described herein provides no-fuss, discrete nursing. While the design of the nursing article 1 is optimal for nursing, the empire waist design is also great for pregnancy and for years thereafter. The comfort provided by the nursing article 1 makes it suitable for 24 hour, day and night wear. The upper inner layer 16 alone or together with the upper outer layer 42 may be configured for easy replacement of nursing pads. For example, the stretch of the respective upper layers allows a wearer to easily separate the material from the breast to insert, remove, or replace a nursing pad. In some embodiments, the upper inner layer 16 may be configured with a pocket or securing or positioning mechanism for retention of a nursing pad. In these or other embodiments, the elasticity of the upper inner layer 16 is sufficient to retain a nursing pad over the nipple when released and positioned over a breast of a wearer.

Figure 3A:
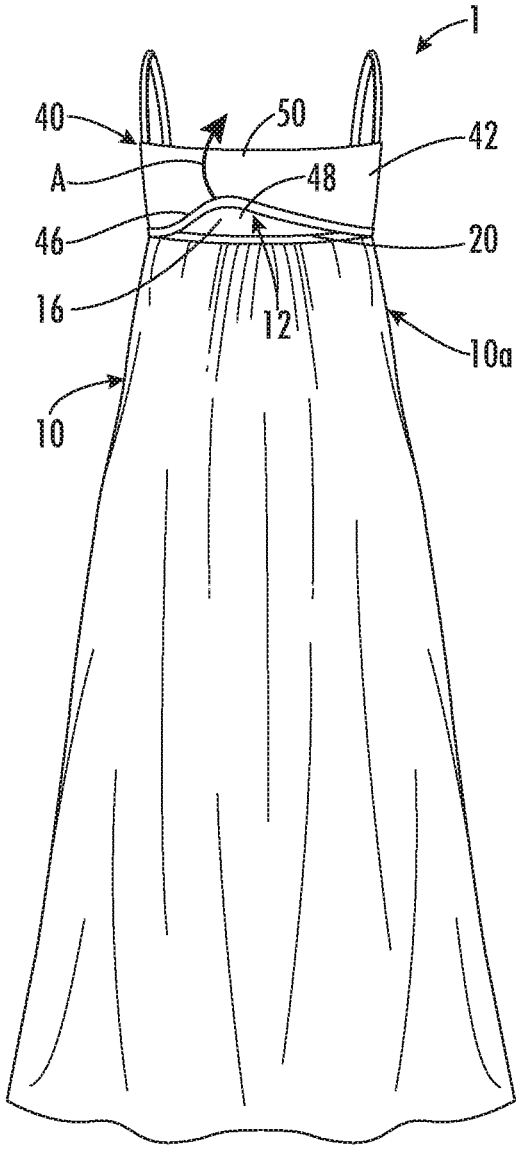
FIG. 3A illustrates a combination nursing article showing lifting of a lower edge of the second piece to expose the upper inner layer of the combination nursing article according to various embodiments described herein.
Figure 3B:
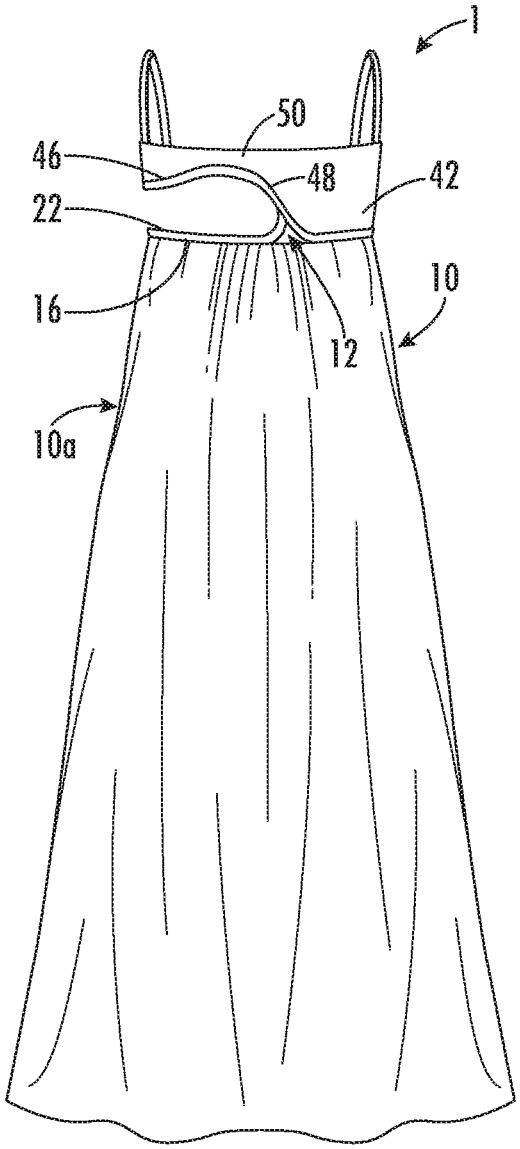
FIG. 3B illustrates the combination nursing article of FIG. 3A with an upper edge of the upper inner layer pulled down to expose an opening for a breast or nipple according to various embodiments described herein.

FIGS. 3A & 3B illustrate a method of exposing a nipple for nursing while wearing the combination nursing article 1.

With particular reference to FIG. 3A, to access a breast or nipple for nursing, the lower edge 48 of the upper outer layer 42 may be lifted upward (arrow A) to access an upper edge 22 of the upper inner layer 16. With further reference to FIG. 3B, the upper edge 22 of upper inner layer 16 may then be pulled downward (arrow B) to expose a nipple for nursing a child. After nursing, the upper edge 22 of the upper inner layer 16 may be lifted upward over the breast and the lower edge 48 of the upper outer layer 42 may be pulled downward over the upper inner layer 16.

While the first piece 10 and second piece 40 are shown as separate pieces, in one embodiment, the first piece 10 and the second piece 40 are attached or attachable, e.g., along rear portions of the first and second pieces 10, 40.

Figure 4:
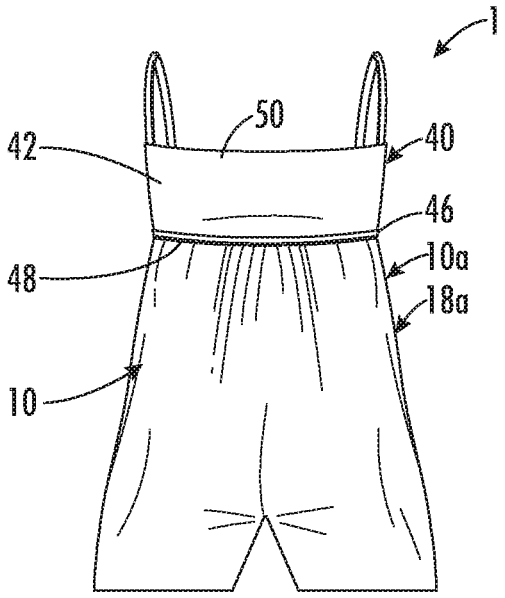
FIG. 4 illustrates a front view of a combination nursing article according to various embodiments described herein.
Figure 5:
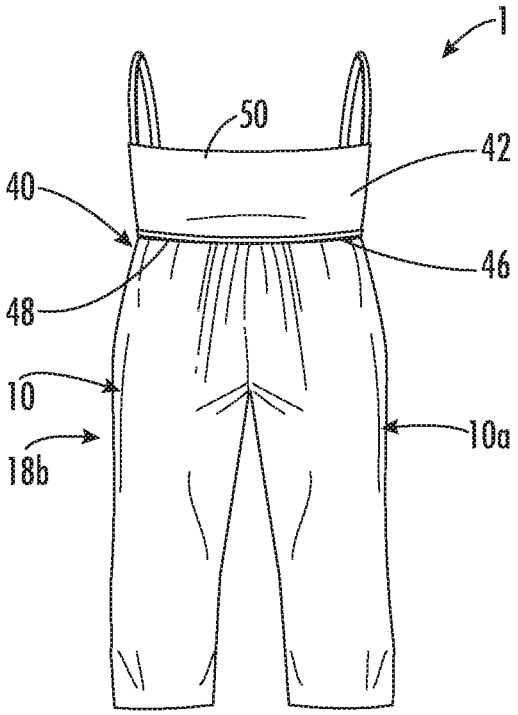
FIG. 5 illustrates a front view of a combination nursing article according to various embodiments described herein.

As noted above, the lower portion 14 of the first piece 10 may comprise various configurations. FIG. 4 illustrates a lower portion 14 comprising shorts 18*a*. FIG. 5 illustrates an example lower portion comprising pants 18*b*. In the illustrated embodiment, the pants 18*b* are capri style, however various pant styles may be used such as long, skinny, harem, straight, leggings, cargo, stirrup, flared, palazzo, tapered, or other pant style.

This specification has been written with reference to various non-limiting and non-exhaustive embodiments. However, it will be recognized by persons having ordinary skill in the art that various substitutions, modifications, or combinations of any of the disclosed embodiments (or portions thereof) may be made within the scope of this specification. Thus, it is contemplated and understood that this specification supports additional embodiments not expressly set forth in this specification. Such embodiments may be obtained, for example, by combining, modifying, or reorganizing any of the disclosed steps, components, elements, features, aspects, characteristics, limitations, and the like, of the various non-limiting and non-exhaustive embodiments described in this specification.

The grammatical articles "one", "a", "an", and "the", as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and may be employed or used in an application of the described embodiments. Further, the use of a singular noun includes the plural, and the use of a plural noun includes the singular, unless the context of the usage requires otherwise. Additionally, the grammatical conjunctions "and" and "or" are used herein according to accepted usage. By way of example, "x and y" refers to "x" and "y". On the other hand, "x or y" refers to "x", "y", or both "x" and "y", whereas "either x or y" refers to exclusivity.

Any numerical range recited herein includes all values and ranges from the lower value to the upper value. For example, if a concentration range is stated as 1% to 50%, it is intended that values such as 2% to 40%, 10% to 30%, 1% to 3%, or 2%, 25%, 39% and the like, are expressly enumerated in this specification. These are only examples of what is specifically intended, and all possible combinations of numerical values and ranges between and including the lowest value and the highest value enumerated are to be considered to be expressly stated in this application. Numbers modified by the term "approximately" are intended to include +/−10% of the number modified.

The present disclosure may be embodied in other forms without departing from the spirit or essential attributes thereof and, accordingly, reference should be had to the following claims rather than the foregoing specification as indicating the scope of the invention. Further, the illustrations of arrangements described herein are intended to provide a general understanding of the various embodiments, and they are not intended to serve as a complete description. Many other arrangements will be apparent to those of skill in the art upon reviewing the above description. Other arrangements may be utilized and derived therefrom, such that logical substitutions and changes may be made without departing from the scope of this disclosure.

What is claimed is:

1. A combination nursing article comprising:

a first piece comprising an upper portion, a lower portion, and an empire waist between the upper and lower portions, wherein the upper portion comprises an upper inner layer that extends from the empire waist to an upper end of the upper portion that defines a terminal upper edge of the upper inner layer, the upper inner layer configured to extend over a bust of a wearer to position the terminal upper edge above a nipple of the wearer, and wherein the empire waist comprises an elastomeric band configured to apply sufficient pressure along a torso of the wearer to maintain a position of the upper portion and lower portion relative to the torso; and a second piece comprising an upper outer layer configured to be worn as a camisole bra over the upper inner layer and dimension to snuggly fit around the breasts of the wearer, the second piece further comprising an elastomeric band configured to extend over the first piece, below breasts and around the torso of the wearer with sufficient elastomeric properties to provide support for the breasts, wherein, when worn, a lower edge of the second piece is configured to be lifted and pulled upwardly to expose the terminal upper edge of the upper inner portion and the terminal upper edge of the upper inner portion is configured to be pulled downwardly below the nipple of the wearer to expose the nipple for nursing.

2. The combination nursing article of claim 1, wherein the lower edge of the second piece comprises the elastomeric band.

3. The combination nursing article of claim 1, wherein the elastomeric band of the second piece is configured to overlap with the elastomeric band of the first piece when worn.

4. The combination nursing article of claim 1, wherein the second piece comprises one or more shoulder straps.

5. The combination nursing article of claim 1, wherein the lower portion comprises a skirt.

6. The combination nursing article of claim 1, wherein the lower portion comprises shorts or pants.

7. The combination nursing article of claim 1, wherein the upper outer layer and the upper inner layer comprise four layers of fabric.

8. The combination nursing article of claim 1, wherein the upper outer layer and the upper inner layer each comprise two to four layers of fabric.

9. The combination nursing article of claim 1, wherein the upper inner layer comprises two to four layers of fabric.

10. The combination nursing article of claim 1, wherein the first piece and second piece are separate pieces.

* * * * *